US008926766B2

(12) United States Patent
Shimamura et al.

(10) Patent No.: US 8,926,766 B2
(45) Date of Patent: Jan. 6, 2015

(54) LOW YIELD RATIO, HIGH STRENGTH AND HIGH UNIFORM ELONGATION STEEL PLATE AND METHOD FOR MANUFACTURING THE SAME

(75) Inventors: Junji Shimamura, Fukuyama (JP); Nobuyuki Ishikawa, Fukuyama (JP); Nobuo Shikanai, Chiyoda-ku (JP)

(73) Assignee: JFE Steel Corporation, Tokyo (JP)

( * ) Notice: Subject to any disclaimer, the term of this patent is extended or adjusted under 35 U.S.C. 154(b) by 121 days.

(21) Appl. No.: 13/499,455

(22) PCT Filed: Sep. 28, 2010

(86) PCT No.: PCT/JP2010/067311
§ 371 (c)(1),
(2), (4) Date: Jun. 11, 2012

(87) PCT Pub. No.: WO2011/040622
PCT Pub. Date: Apr. 7, 2011

(65) Prior Publication Data

US 2012/0247625 A1 Oct. 4, 2012

(30) Foreign Application Priority Data

Sep. 30, 2009 (JP) ..... 2009-226703

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C21D 8/02*** | (2006.01) |

(52) U.S. Cl.
CPC ..... *C21D 8/0226* (2013.01); *C21D 8/0263* (2013.01); *C22C 38/12* (2013.01); *C22C 38/14* (2013.01); *C21D 2211/002* (2013.01); *C21D 2211/008* (2013.01)
USPC ..... 148/320; 148/328; 148/332; 148/333; 148/334; 148/336; 148/653

(58) Field of Classification Search
CPC ..... C22C 38/04; C22C 38/06; C22C 38/14; C22C 38/12; C21D 8/0226
USPC ..... 148/654, 328, 320, 332–336
See application file for complete search history.

(56) References Cited

FOREIGN PATENT DOCUMENTS

| | | |
|---|---|---|
| JP | 55-041927 A | 3/1980 |
| JP | 55-097425 A | 7/1980 |

(Continued)

OTHER PUBLICATIONS

Machine-English translation of Japanese patent No. 2007-177266, Ueda Keiji et al., Jul. 12, 2007.*

(Continued)

*Primary Examiner* — Deborah Yee
(74) *Attorney, Agent, or Firm* — RatnerPrestia

(57) ABSTRACT

Provided is a low yield ratio, high strength and high uniform elongation steel plate having excellent strain ageing resistance equivalent to API 5L X70 Grade or lower and a method for manufacturing the same. In particular, the steel plate contains 0.06% to 0.12% C, 0.01% to 1.0% Si, 1.2% to 3.0% Mn, 0.015% or less P, 0.005% or less S, 0.08% or less Al, 0.005% to 0.07% Nb, 0.005% to 0.025% Ti, 0.010% or less N, and 0.005% or less O on a mass basis, the remainder being Fe and unavoidable impurities. The low yield ratio, high strength and high uniform elongation steel plate has a metallographic microstructure that is a two-phase microstructure consisting of bainite and M-A constituent, the area fraction of the M-A constituent being 3% to 20%, the equivalent circle diameter of the M-A constituent being 3.0 μm or less.

3 Claims, 2 Drawing Sheets

(56) References Cited

FOREIGN PATENT DOCUMENTS

| | | | |
|---|---|---|---|
| JP | 11-76027 | A | 7/1989 |
| JP | 2005-023403 | A | 1/2005 |
| JP | 2005-048224 | A | 2/2005 |
| JP | 2005-060839 | A | 3/2005 |
| JP | 2005-060840 | A | 3/2005 |
| JP | 2007-177266 | A | 7/2007 |
| JP | 2008-2488328 | A | 10/2008 |
| JP | 2008-308736 | A | 12/2008 |
| JP | 2009-197282 | A | 9/2009 |

OTHER PUBLICATIONS

Machine-English translation of Japanese patent No. 2008-308736, Ueda Keiji et al., Dec. 25, 2008.*

International Search Report dated Dec. 21, 2010, application No. PCT/JP2010/067311.

* cited by examiner

LOW YIELD RATIO, HIGH STRENGTH AND HIGH UNIFORM ELONGATION STEEL PLATE AND METHOD FOR MANUFACTURING THE SAME

CROSS-REFERENCE TO RELATED APPLICATIONS

This application is the U.S. National Phase application of PCT International Application No. PCT/JP2010/067311, filed Sep. 28, 2010, and claims priority to Japanese Patent Application No. 2009-226703, filed Sep. 30, 2009, the disclosures of which PCT and priority applications are incorporated herein by reference in their entireties for all purposes.

FIELD OF THE INVENTION

The present invention relates to low yield ratio, high strength and high uniform elongation steel plates suitable for use mainly in line pipes and methods for manufacturing the same and particularly relates to a low yield ratio, high strength and high uniform elongation steel plate having excellent strain ageing resistance and a method for manufacturing the same. The term "uniform elongation" as used herein is also called even elongation and refers to the limit of the permanent elongation of a parallel portion of a specimen uniformly deformed in a tensile test. The uniform elongation is usually determined in the form of the permanent elongation corresponding to the maximum tensile load.

BACKGROUND OF THE INVENTION

In recent years, steels for welded structures have been required to have low yield strength and high uniform elongation in addition to high strength and high toughness from the viewpoint of earthquake-proof. For example, steels for line pipes used in quake zones which may possibly be deformed significantly are required to have low yield strength and high uniform elongation in some cases. In general, it is known that the yield strength and uniform elongation of steel can be reduced and increased, respectively, in such a manner that the metallographic microstructure of the steel is transformed into a microstructure in which a hard phase such as bainite or martensite is adequately dispersed in ferrite, which is a soft phase.

As for manufacturing methods capable of obtaining a microstructure in which a hard phase is adequately dispersed in a soft phase as described above, Patent Literature 1 discloses a heat treatment method in which quenching (Q') from the two-phase ($\gamma+\alpha$) temperature range of ferrite and austenite is performed between quenching (Q) and tempering (T).

As for methods in which the number of manufacturing steps is not increased, Patent Literature 2 discloses a method in which after rolling is finished at the $Ar_3$ transformation temperature or higher, the start of accelerated cooling is delayed until the temperature of a steel material decreases to the $Ar_3$ transformation temperature, at which ferrite is produced, or lower.

As for techniques for achieving low yield ratio without performing such heat treatment as disclosed in Patent Literature 1 or 2, Patent Literature 3 discloses a method in which low yield ratio is achieved in such a manner that after the rolling of a steel material is finished at the $Ar_3$ transformation temperature or higher, the rate of accelerated cooling and the finishing cooling temperature are controlled such that a two-phase microstructure consisting of acicular ferrite and martensite is produced.

Furthermore, as for techniques for achieving low yield ratio and excellent welded heat affected zone toughness without significantly increasing the amount of an alloying element added to steel, Patent Literature 4 discloses a method in which a three-phase microstructure consisting of ferrite, bainite, and island martensite (M-A constituent) is produced in such a manner that Ti/N and/or the Ca—O—S balance is controlled.

Patent Literature 5 discloses a technique in which low yield ratio and high uniform elongation are achieved by the addition of an alloying element such as Cu, Ni, or Mo.

On the other hand, welded steel pipes, such as UOE steel pipes and electric welded pipes, used for line pipes are manufactured in such a manner that steel plates are cold-formed into pipes, abutting surfaces thereof are welded, and the outer surfaces of the pipes are usually subjected to coating such as polyethylene coating or powder epoxy coating from the viewpoint of corrosion resistance. Therefore, there is a problem in that the steel pipes have a yield ratio greater than the yield ratio of the steel plates because strain ageing is caused by working strain during pipe making and heating during coating and the yield stress is increased. In order to cope with such a problem, for example, Patent Literatures 6 and 7 each disclose a steel pipe which has excellent strain ageing resistance, low yield ratio, high strength, and high toughness and which contains fine precipitates of composite carbides containing Ti and Mo or fine precipitates of composite carbides containing two or more of Ti, Nb, and V and also disclose a method for manufacturing the steel pipe.

PATENT LITERATURE

PTL 1: Japanese Unexamined Patent Application Publication No. 55-97425

PTL 2: Japanese Unexamined Patent Application Publication No. 55-41927

PTL 3: Japanese Unexamined Patent Application Publication No. 1-176027

PTL 4: Japanese Patent No. 4066905 (Japanese Unexamined Patent Application Publication No. 2005-48224)

PTL 5: Japanese Unexamined Patent Application Publication No. 2008-248328

PTL 6: Japanese Unexamined Patent Application Publication No. 2005-60839

PTL 7: Japanese Unexamined Patent Application Publication No. 2005-60840

SUMMARY OF THE INVENTION

The heat treatment method disclosed in Patent Literature 1 is capable of achieving low yield ratio by appropriately selecting the quenching temperature of the two-phase ($\gamma+\alpha$) temperature range and, however, includes an increased number of heat treatment steps. Therefore, there is a problem in that a reduction in productivity and an increase in manufacturing cost are caused.

In the technique disclosed in Patent Literature 2, cooling needs to be performed at a cooling rate close to a natural cooling rate in the temperature range from the end of rolling to the start of accelerated cooling. Therefore, there is a problem in that productivity is extremely low.

In the technique disclosed in Patent Literature 3, in order to allow a steel material to have a tensile strength of 490 N/mm$^2$ (50 kg/mm$^2$) or more as described in an example, the steel material needs to have an increased carbon content or a composition in which the amount of an added alloying element is increased, which causes an increase in material cost and a problem in that the toughness of a welded heat affected zone is deteriorated.

In the technique disclosed in Patent Literature 4, the influence of a microstructure on uniform elongation performance required for pipelines has not necessarily become clear.

In the technique disclosed in Patent Literature 5, a composition in which the amount of an added alloying element is increased is required, which causes an increase in material cost and a problem in that the toughness of a welded heat affected zone is deteriorated.

In the technique disclosed in Patent Literature 6 or 7, strain ageing resistance is improved; however, it remains unsolved that strain ageing resistance and uniform elongation performance required for pipelines are both ensured.

In Patent Literatures 1 to 7, a ferrite phase is essential. When the ferrite phase is contained, an increase in strength to X60 or higher in API standards causes a reduction in tensile strength and the amount of an alloying element needs to be increased in order to ensure strength, which may possibly cause an increase in alloying cost and a reduction in low-temperature toughness.

As described above, it is difficult for the conventional techniques to manufacture low yield ratio, high strength and high uniform elongation steel plates having excellent welded heat affected zone toughness, high uniform elongation, and excellent strain ageing resistance without causing a reduction in productivity or an increase in manufacturing cost.

Therefore, embodiments of the present invention provide a low yield ratio, high strength and high uniform elongation steel plate and a method for manufacturing the same. The low yield ratio, high strength and high uniform elongation steel plate is capable of solving such problems with the conventional techniques, can be manufactured at high efficiency and low cost, and has high uniform elongation equivalent to API 5L X60 Grade or higher (herein, particularly X65 and X70 Grades).

In order to solve the above problems, the inventors have intensively investigated methods for manufacturing steel plates, particularly manufacturing processes including controlled rolling, accelerated cooling subsequent to controlled rolling, and reheating subsequent thereto. As a result, the inventors have obtained findings below.

(a) Cooling is stopped in a temperature range in which non-transformed austenite is present, that is, during bainite transformation, in the course of accelerated cooling and reheating is started at a temperature higher than the bainite transformation finish temperature (hereinafter referred to as the Bf point), whereby the metallographic microstructure of a steel plate is transformed into a two phase microstructure in which hard M-A constituent (hereinafter referred to as MA) is uniformly produced and bainite and low yield ratio can be achieved.

MA can be readily identified in such a manner that a steel plate is etched with, for example, 3% nital (a solution of nitric acid in alcohol), is subjected to electrolytic etching, and is then observed. MA is observed as a white prominent portion when the microstructure of the steel plate is observed with a scanning electron microscope (SEM).

(b) Since the addition of appropriate amounts of austenite-stabilizing elements such as Mn and Si stabilizes non-transformed austenite, hard MA can be produced without the addition of a large amount of an alloying element such as Cu, Ni, or Mo.

(c) MA can be uniformly and finely dispersed and the uniform elongation can be improved with the yield ratio maintained low by applying an accumulative rolling reduction of 50% or more in a no-recrystallization temperature range in austenite not higher than 900° C.

(d) Furthermore, the shape of MA can be controlled, that is, MA can be refined to an average equivalent circle diameter of 3.0 μm or less by adequately controlling rolling conditions in the no-recrystallization temperature range in austenite described in Item (c) and the reheating conditions described in Item (a). As a result, the decomposition of MA is slight even though such a thermal history that causes the deterioration in yield ratio of conventional steels is suffered; hence, desired structural morphology and properties can be maintained after ageing.

The present invention has been made on the basis of the above findings and additional studies. Exemplary embodiments of the present invention are described below.

A first embodiment of the invention provides a low yield ratio, high strength and high uniform elongation steel plate containing 0.06% to 0.12% C, 0.01% to 1.0% Si, 1.2% to 3.0% Mn, 0.015% or less P, 0.005% or less S, 0.08% or less Al, 0.005% to 0.07% Nb, 0.005% to 0.025% Ti, 0.010% or less N, and 0.005% or less O on a mass basis, the remainder being Fe and unavoidable impurities. The low yield ratio, high strength and high uniform elongation steel plate has a metallographic microstructure that is a two-phase microstructure consisting of bainite and M-A constituent, the area fraction of the M-A constituent being 3% to 20%, the equivalent circle diameter of the M-A constituent being 3.0 μm or less. The low yield ratio, high strength and high uniform elongation steel plate has a uniform elongation of 7% or more and a yield ratio of 85% or less. The low yield ratio, high strength and high uniform elongation steel plate has a uniform elongation of 7% or more and a yield ratio of 85% or less after being subjected to strain ageing treatment at a temperature of 250° C. or lower for 30 minutes or less.

A second embodiment of the invention provides the low yield ratio, high strength and high uniform elongation steel plate, according to the first embodiment, further containing one or more selected from the group consisting of 0.5% or less Cu, 1% or less Ni, 0.5% or less Cr, 0.5% or less Mo, 0.1% or less V, 0.0005% to 0.003% Ca, and 0.005% or less B on a mass basis.

A third embodiment of the invention provides a method for manufacturing a low yield ratio, high strength and high uniform elongation steel plate. The method includes heating steel having the composition specified in the first or second embodiments to a temperature of 1000° C. to 1300° C., hot-rolling the steel at a finishing rolling temperature not lower than the $Ar_3$ transformation temperature such that the accumulative rolling reduction at 900° C. or lower is 50% or more, performing accelerated cooling to a temperature of 500° C. to 680° C. at a cooling rate of 5° C./s or more, and immediately performing reheating to a temperature of 550° C. to 750° C. at a heating rate of 2.0° C./s or more.

According to an exemplary embodiment of the present invention, a low yield ratio, high strength and uniform elongation steel plate having high uniform elongation properties can be manufactured at low cost without deteriorating the toughness of a welded heat affected zone or adding a large amount of an alloying element. Therefore, a large number of steel plates mainly used for line pipes can be stably manufactured at low cost and productivity and economic efficiency can be significantly increased, which is extremely industrially advantageous.

DETAILED DESCRIPTION OF THE INVENTION

Figure 1:
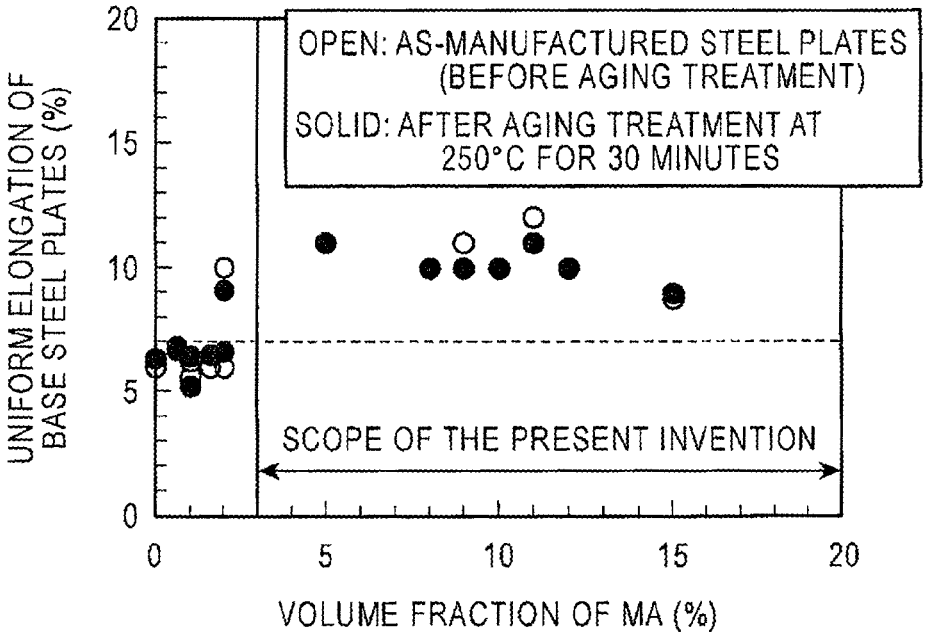
FIG. 1 is a graph showing the relationship between the area fraction of MA and the uniform elongation of base materials.

Reasons for limiting components of the present invention are described below.

1. Composition

Reasons for limiting the composition of steel according to aspects of the present invention are first described. The percentages of all components are on a mass basis.

C: 0.06% to 0.12%

C is an element which contributes to precipitation hardening in the form of carbides and which is important in producing MA. The addition of less than 0.06% C is insufficient to produce MA and therefore sufficient strength cannot possibly be ensured. The addition of more than 0.12% C deteriorates the toughness of a welded heat affected zone (HAZ). Therefore, the content of C is within the range of 0.06% to 0.12%. The content thereof is preferably within the range of 0.06% to 0.10%.

Si: 0.01% to 1.0%

Si is added for deoxidation. The addition of less than 0.01% Si is insufficient to obtain a deoxidation effect. The addition of more than 1.0% Si causes the deterioration of toughness and weldability. Therefore, the content of Si is within the range of 0.01% to 1.0%. The content thereof is preferably within the range of 0.1% to 0.3%.

Mn: 1.2% to 3.0%

Mn is added for the improvement of strength, toughness, and hardenability to promote the production of MA. The addition of less than 1.2% Mn is insufficient to obtain such an effect. The addition of more than 3.0% Mn causes the deterioration of toughness and weldability. Therefore, the content of Mn is within the range of 1.2% to 3.0%. In order to stably produce MA independently of the variation of components and manufacturing conditions, the content thereof is preferably 1.5% or more. The content thereof is more preferably within the range of 1.5% to 1.8%.

P and S: 0.015% or less and 0.005% or less, respectively

According to aspects of the present invention, P and S are unavoidable impurities and therefore the upper limits of the contents thereof are limited. High P content causes significant center segregation to deteriorate the toughness of the base material; hence, the content of P is 0.015% or less. High S content causes a significant increase in production of MnS to deteriorate the toughness of the base material; hence, the content of S is 0.005% or less. The content of P is preferably 0.010% or less. The content of S is preferably 0.002% or less.

Al: 0.08% or less

Al is added as a deoxidizing agent. The addition of less than 0.01% Al is insufficient to obtain a deoxidation effect. The addition of more than 0.08% Al causes a decrease in cleanliness and a reduction in toughness of the steel. Therefore, the content of Al is 0.08% or less. The content thereof is preferably within the range of 0.01% to 0.08% and more preferably 0.01% to 0.05%.

Nb: 0.005% to 0.07%

Nb is an element which contributes to the increase of toughness due to the refining of a microstructure and also contributes to the increase of strength due to an increase in hardenability of solute Nb. Such effects are developed by the addition of 0.005% or more Nb. However, the addition of less than 0.005% Nb is ineffective. The addition of more than 0.07% Nb deteriorates the toughness of the welded heat affected zone. Therefore, the content of Nb is within the range of 0.005% to 0.07%. The content thereof is preferably within the range of 0.01% to 0.05%.

Ti: 0.005% to 0.025%

Ti is an important element which suppresses the coarsening of austenite during the heating of a slab by a pinning effect to increase the toughness of the base material. Such an effect is developed by the addition of 0.005% or more Ti. However, the addition of more than 0.025% Ti deteriorates the toughness of the welded heat affected zone. Therefore, the content of Ti is within the range of 0.005% to 0.025%. From the viewpoint of the toughness of the welded heat affected zone, the content of Ti is preferably within the range of 0.005% to less than 0.02% and more preferably 0.007% to 0.016%.

N: 0.010% or less

N is treated as an unavoidable impurity. When the content of N is more than 0.010%, the toughness of the welded heat affected zone is deteriorated. Therefore, the content of N is 0.010% or less. The content thereof is preferably 0.007% or less and more preferably 0.006% or less.

O: 0.005% or less

According to aspects of the present invention, O is an unavoidable impurity and therefore the upper limit of the content thereof is limited. O is a cause of the production of coarse inclusions adversely affecting toughness. Therefore, the content of O is 0.005% or less. The content thereof is preferably 0.003% or less.

Those described above are preferred components in the present invention. For the purposes of improving the strength and toughness of a steel plate, enhancing the hardenability thereof, and promoting the production of MA, one or more of Cu, Ni, Cr, Mo, V, Ca, and B may be contained therein as described below.

Cu: 0.5% or less

Cu need not be added. However, Cu may be added because the addition thereof contributes to the enhancement of the hardenability of the steel. In order to obtain such an effect, the addition of 0.05% or more Cu is preferred. However, the addition of more than 0.5% Cu causes the deterioration of toughness. Therefore, in the case of adding Cu, the content of Cu is preferably 0.5% or less and more preferably 0.4% or less.

Ni: 1% or less

Ni need not be added. However, Ni may be added because the addition thereof contributes to the enhancement of the hardenability of the steel and the addition a large amount thereof does not cause the deterioration of toughness and is effective in strengthening. In order to obtain such effects, the addition of 0.05% or more Ni is preferred. However, the content of Ni is preferably 1% or less and more preferably 0.4% or less in the case of adding Ni because Ni is an expensive element.

Cr: 0.5% or less

Cr need not be added. However, Cr may be added because Cr, as well as Mn, is an element effective in obtaining sufficient strength even if the content of C thereof is low. In order to obtain such an effect, the addition of 0.1% or more Cr is preferred. However, the excessive addition thereof causes the deterioration of weldability. Therefore, in the case of adding Cr, the content of Cr is preferably 0.5% or less and more preferably 0.4% or less.

Mo: 0.5% or less

Mo need not be added. However, Mo may be added because Mo is an element which enhances the hardenability and which produces MA and strengthens a bainite phase to contribute to the increase of strength. In order to obtain such effects, the addition of 0.05% or more Mo is preferred. However, the addition of more than 0.5% Mo causes the deterioration in toughness of the welded heat affected zone. Therefore, in the case of adding Mo, the content of Mo is preferably 0.5% or less and more preferably 0.3% or less.

V: 0.1% or less

V need not be added. However, V may be added because V is an element which enhances the hardenability and which contributes to the increase of the strength. In order to obtain such effects, the addition of 0.005% or more V is preferred. However, the addition of more than 0.1% V causes the deterioration in toughness of the welded heat affected zone. Therefore, in the case of adding V, the content of V is preferably 0.1% or less and more preferably 0.06% or less.

Ca: 0.0005% to 0.003%

Ca controls the morphology of sulfide inclusions to improve the toughness and therefore may be added. When the content thereof is 0.0005% or more, such an effect is developed. When the content thereof is more than 0.003%, the effect is saturated, the cleanliness is reduced, and the toughness is deteriorated. Therefore, in the case of adding Ca, the content of Ca is preferably in the range of 0.0005% to 0.003% and more preferably 0.001% to 0.003%.

B: 0.005% or less

B may be added because B is an element contributing to the improvement in toughness of the welded heat affected zone. In order to obtain such an effect, the addition of 0.0005% or more B is preferred. However, the addition of more than 0.005% B causes the deterioration of weldability. Therefore, in the case of adding B, the content of B is preferably 0.005% or less and more preferably 0.003% or less.

The optimization of the ratio Ti/N that is the ratio of the content of Ti to the content of N allows the coarsening of austenite in the welded heat affected zone to be suppressed due to TiN grains and allows the welded heat affected zone to have good toughness. Therefore, the ratio Ti/N is preferably within the range of 2 to 8 and more preferably 2 to 5.

The remainder, other than the above components of the steel plate according to embodiments of the present invention, is Fe and unavoidable impurities. It is not denied that an element other than those described above may be contained therein, unless advantageous effects of the present invention are impaired. From the viewpoint of the improvement of toughness, for example, 0.02% or less Mg and/or 0.02% or less of a REM (rare-earth metal) may be contained therein.

A metallographic microstructure according to an exemplary embodiment of the present invention is described below.

2. Metallographic Microstructure

In an exemplary embodiment of the present invention, the metallographic microstructure uniformly contains bainite, which is a main phase, and M-A constituent (MA) having a area fraction of 3% to 20% and an equivalent circle diameter of 3.0 μm or less. The term "main phase" as used herein refers to a phase with a area fraction of 80% or more.

The steel plate has a two-phase microstructure consisting of bainite and MA uniformly produced therein, that is, a composite microstructure containing soft tempered bainite and hard MA and therefore has low yield ratio and high uniform elongation. In the composite microstructure, which contains soft tempered bainite and hard MA, a soft phase is responsible for deformation and therefore a high uniform elongation of 7% or more can be achieved.

The percentage of MA in the microstructure is 3% to 20% in terms of the area fraction (calculated from the average of the percentages of the areas of MA in arbitrary cross sections of the steel plate in the rolling direction thereof, the thickness direction thereof, and the like) of MA. An MA area fraction of less than 3% is insufficient to achieve low yield ratio and high uniform elongation in some cases and an MA area fraction of more than 20% causes the deterioration in toughness of the base material in some cases.

Figure 2:
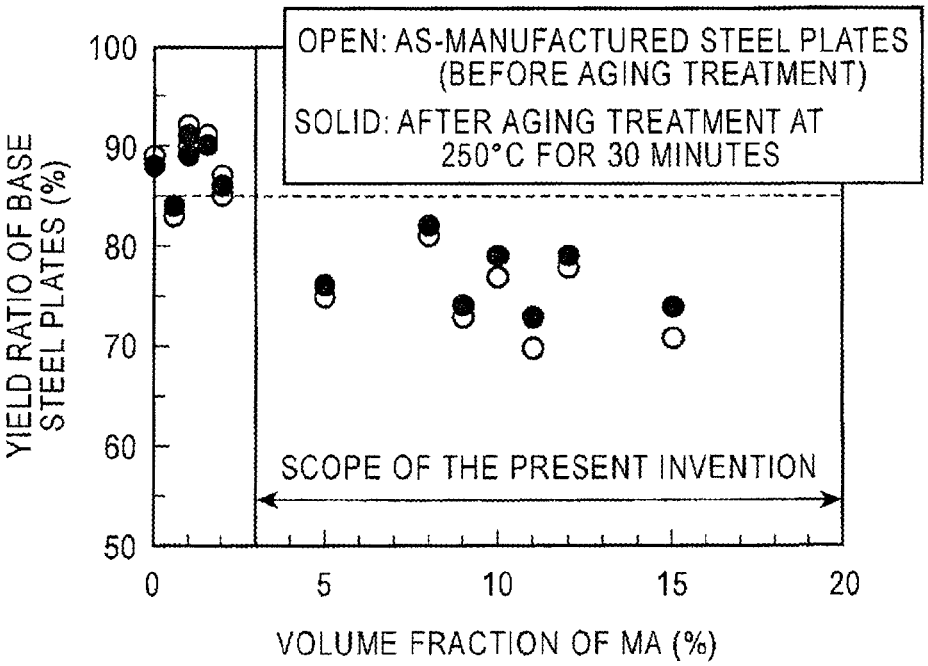
FIG. 2 is a graph showing the relationship between the area fraction of MA and the yield ratio of base materials.

From the viewpoint of the reduction of yield ratio and the increase of uniform elongation, the area fraction of MA is preferably 5% to 12%. FIG. 1 shows the relationship between the area fraction of MA and the uniform elongation of base materials. It is difficult to achieve a uniform elongation of 7% or more when the area fraction of MA is less than 3%. FIG. 2 shows the relationship between the area fraction of MA and the yield ratio of base materials. It is difficult to achieve a yield ratio of 85% or less when the area fraction of MA is less than 3%.

The area fraction of MA can be calculated from the average of the percentages of the areas of MA in microstructure photographs of at least four fields or more of view, the photographs being obtained by, for example, SEM (scanning electron microscope) observation and being subjected to image processing.

Figure 3:
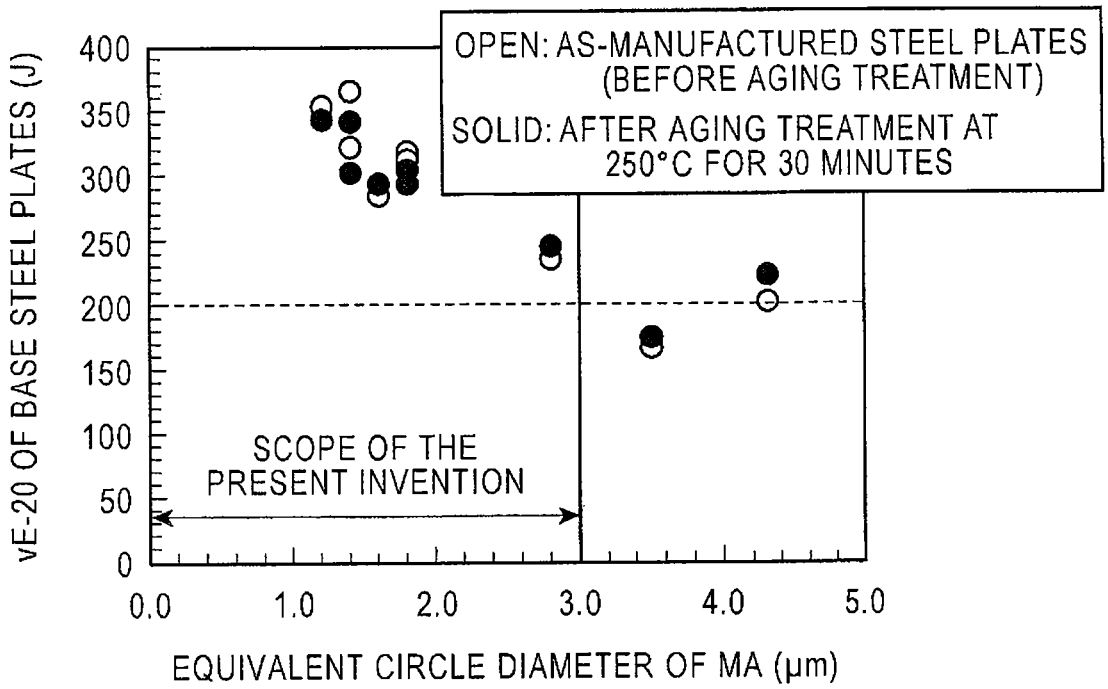
FIG. 3 is a graph showing the relationship between the area fraction of MA and the toughness of base materials.

From the viewpoint of ensuring the toughness of the base material, the equivalent circle diameter of MA is 3.0 μm or less. FIG. 3 shows the relationship between the equivalent circle diameter of MA and the toughness of base materials. It is difficult to adjust the Charpy absorbed energy of a base material to 200 J or more at −20° C. when the equivalent circle diameter of MA is less than 3.0

The equivalent circle diameter of MA can be determined in such a manner that a microstructure photograph obtained by SEM observation is subjected to image processing and the diameters of circles equal in area to individual MA grains are determined and are then averaged.

In an exemplary embodiment of the present invention, in order to produce MA without adding a large amount of an expensive alloying element such as Cu, Ni, or Mo, it is important that non-transformed austenite is stabilized by the addition of Mn and Si and pearlitic transformation and cementite precipitation are suppressed during reheating and air cooling subsequent thereto.

From the viewpoint of suppressing ferrite precipitation, the initial cooling temperature is preferably not lower than the $Ar_3$ transformation temperature.

In an exemplary embodiment of the present invention, the mechanism of MA production is as described below. Detailed manufacturing conditions are described below.

After a slab is heated, rolling is finished in the austenite region and accelerated cooling is started at the $Ar_3$ transformation temperature or higher.

In the following process, the change of the microstructure is as described below: a manufacturing process in which accelerated cooling is finished during bainite transformation, that is, in a temperature range in which non-transformed austenite is present, reheating is performed at a temperature higher than the finish temperature (Bf point) of bainite transformation, and cooling is then performed.

The microstructure contains bainite and non-transformed austenite at the end of accelerated cooling. Reheating is performed at a temperature higher than the Bf point, whereby non-transformed austenite is transformed into bainite. Since the amount of solid solution of carbon in bainite produced at such a relatively high temperature is small, C is emitted into surrounding non-transformed austenite.

Therefore, the amount of C in non-transformed austenite increases as bainite transformation proceeds during reheating. When certain amounts of Mn, Si, and the like, which are austenite-stabilizing elements, are contained, non-transformed austenite in which C is concentrated remains at the end of reheating and is then transformed into MA during cooling subsequent to reheating. The microstructure finally contains bainite and MA produced therein.

In an exemplary embodiment of the present invention, it is important that reheating is performed subsequently to accelerated cooling in a temperature range in which non-transformed austenite is present. When the initial reheating temperature is not higher than the Bf point, bainite transformation is completed and non-transformed austenite is not present. Therefore, the initial reheating temperature needs to be higher than the Bf point.

Cooling subsequent to reheating does not affect the transformation of MA, therefore is not particularly limited, and is preferably air cooling principally. In an exemplary embodiment of the present invention, steel containing certain amounts of Mn and Si is used, accelerated cooling is stopped during bainite transformation, and continuous reheating is immediately performed, whereby hard MA can be produced without reducing manufacturing efficiency.

The steel according to an exemplary embodiment of the present invention has the metallographic microstructure, which uniformly contains bainite, which is a main phase, and a certain amount of MA. Those containing a microstructure other than bainite and MA or a precipitate are included in the scope of the present invention unless advantageous effects of the present invention are impaired.

In particular, when one or more of ferrite (particularly polygonal ferrite), pearlite, cementite, and the like coexist, the strength is reduced. However, when the area fraction of a microstructure other than bainite and MA is small, a reduction in strength is negligible. Therefore, a metallographic microstructure other than bainite and MA, that is, one or more of ferrite, pearlite, cementite, and the like may be contained when the total area fraction thereof in the microstructure is 30 or less.

The above-mentioned metallographic microstructure can be obtained in such a manner that the steel having the above-mentioned composition is manufactured by a method below.

3. Manufacturing Conditions

It is preferred that the steel having the above-mentioned composition is produced in a production unit such as a steel converter or an electric furnace in accordance with common practice and is then processed into a steel material such as a slab by continuous casting or ingot casting-blooming in accordance with common practice. A production process and a casting process are not limited to the above processes. The steel material is rolled so as to have desired properties and a desired shape, is cooled subsequently to rolling, and is then heated.

In an exemplary embodiment of the present invention, each of temperatures such as the heating temperature, the finishing rolling temperature, the finishing cooling temperature, and the reheating temperature is the average temperature of the steel plate. The average temperature thereof is determined from the surface temperature of a slab or the steel plate by calculation in consideration of a parameter such as thickness or thermal conductivity. The cooling rate is the average obtained by dividing the temperature difference required for cooling to a finishing cooling temperature (500° C. to 680° C.) by the time taken to perform cooling after hot rolling is finished.

The heating rate is the average obtained by dividing the temperature difference required for reheating to a reheating temperature (550° C. to 750° C.) by the time taken to perform reheating after cooling. Manufacturing conditions are described below in detail.

The $Ar_3$ transformation temperature used is a value calculated by the following equation:

$$Ar_3(^\circ C.)=910-310C-80Mn-20Cu-15Cr-55Ni-80Mo.$$

Heating temperature: 1000° C. to 1300° C.

When the heating temperature is lower than 1000° C., the solid solution of carbides is insufficient and required strength cannot be achieved. When the heating temperature is higher than 1300° C., the toughness of the base material is deteriorated. Therefore, the heating temperature is within the range of 1000° C. to 1300° C.

Finishing rolling temperature: not lower than $Ar_3$ transformation temperature

When the finishing rolling temperature is lower than the $Ar_3$ transformation temperature, the concentration of C in non-transformed austenite is insufficient during reheating and therefore MA is not produced because the transformation rate of ferrite is reduced. Therefore, the finishing rolling temperature is not lower than the $Ar_3$ transformation temperature.

Accumulative rolling reduction at 900° C. or lower: 50% or more

This condition is one of important manufacturing conditions. A temperature range not higher than 900° C. corresponds to the no-recrystallization temperature range in austenite. When the accumulative rolling reduction in this temperature range is 50% or more, austenite grains can be refined and therefore the number of sites producing MA at prior austenite grain boundaries is increased, which contributes to suppressing the coarsening of MA.

When the accumulative rolling reduction at 900° C. or lower is less than 50%, the uniform elongation is reduced or the toughness of the base material is reduced in some cases because the equivalent circle diameter of produced MA exceeds 3.0 μm. Therefore, the accumulative rolling reduction at 900° C. or lower is 50% or more.

Cooling rate and finishing cooling temperature: 5° C./s or more and 500° C. to 680° C., respectively Accelerated cooling is performed immediately after rolling is finished. In the case where the initial cooling temperature is not higher than the $Ar_3$ transformation temperature and therefore polygonal ferrite is produced, a reduction in strength is caused and MA is unlikely to be produced. Therefore, the initial cooling temperature is preferably not lower than the $Ar_3$ transformation temperature.

The cooling rate is 5° C./s or more. When the cooling rate is less than 5° C./s, pearlite is produced during cooling and therefore sufficient strength or low yield ratio cannot be achieved. Therefore, the cooling rate after rolling is 5° C./s or more.

In an exemplary embodiment of the present invention, supercooling is performed to a bainite transformation region by accelerated cooling, whereby bainite transformation can be completed during reheating without temperature maintenance during reheating.

The finishing cooling temperature is 500° C. to 680° C. In exemplary embodiments of the present invention, this process is an important manufacturing condition. In an exemplary embodiment of the present invention, non-transformed austenite which is present after reheating and in which C is concentrated is transformed into MA during air cooling.

That is, cooling needs to be finished in a temperature range in which non-transformed austenite that is being transformed into bainite is present. When the finishing cooling temperature is lower than 500° C., bainite transformation is completed; hence, MA is not produced during cooling and therefore low yield ratio cannot be achieved. When the finishing cooling temperature is higher than 680° C., C is consumed by pearlite precipitated during cooling and therefore MA is not produced. Therefore, the finishing cooling temperature is 500° C. to 680° C. In order to ensure the area fraction of MA that is preferable in achieving better strength and toughness, the finishing cooling temperature is preferably 550° C. to 660° C. An arbitrary cooling system can be used for accelerated cooling.

Heating rate after accelerated cooling and reheating temperature: 2.0° C./s or more and 550° C. to 750° C., respectively Reheating is performed to a temperature of 550° C. to 750° C. at a heating rate of 2.0° C./s or more immediately after accelerated cooling is finished. The expression "reheating is performed immediately after accelerated cooling is finished" as used herein means that reheating is performed a heating rate of 2.0° C./s or more within 120 seconds after accelerated cooling is finished.

In an exemplary embodiment of the present invention, this process is also an important manufacturing condition. Non-transformed austenite is transformed into bainite during reheating subsequent to accelerated cooling as described above and therefore C is emitted into remaining non-transformed austenite. The non-transformed austenite in which C is concentrated is transformed into MA during air cooling subsequent to reheating.

In order to obtain MA, reheating needs to be performed from a temperature not lower than the Bf point to a temperature of 550° C. to 750° C. after accelerated cooling.

When the heating rate is less than 2.0° C./s, it takes a long time to achieve a target heating temperature and therefore manufacturing efficiency is low. Furthermore, the coarsening of MA is caused in some cases and low yield ratio or sufficient uniform elongation cannot be achieved. This mechanism is not necessarily clear but is believed to be that the coarsening of a C-concentrated region and the coarsening of MA produced during cooling subsequent to reheating are suppressed by increasing the heating rate during reheating to 2.0° C./s or more.

When the reheating temperature is lower than 550° C., bainite transformation does not occur sufficiently and the emission of C into non-transformed austenite is insufficient; hence, MA is not produced and low yield ratio cannot be achieved. When the reheating temperature is higher than 750° C., sufficient strength cannot be achieved because of the softening of bainite. Therefore, the reheating temperature is within the range of 550° C. to 750° C.

In an exemplary embodiment of the present invention, it is important to perform reheating subsequent to accelerated cooling from a temperature range in which non-transformed austenite is present. When the initial reheating temperature is not higher than the Bf point, bainite transformation is completed and therefore non-transformed austenite is not present. Therefore, the initial reheating temperature needs to be higher than the Bf point.

In order to securely concentrate C, which is being transformed into bainite, in non-transformed austenite, the temperature is preferably increased from the initial reheating temperature by 50° C. or more. The time to maintain the initial reheating temperature need not be particularly set.

Since MA is sufficiently obtained by a manufacturing method according to embodiments of the present invention even if cooling is performed immediately after reheating, low yield ratio and high uniform elongation can be achieved. However, in order to promote the diffusion of C to ensure the area fraction of MA, temperature maintenance may be performed for 30 minutes or less during reheating. If temperature maintenance is performed for more than 30 minutes, then recovery occurs in a bainite phase to cause a reduction in strength in some cases.

Basically, the rate of cooling subsequent to reheating is preferably equal to the rate of air cooling.

In order to perform reheating subsequently to accelerated cooling, a heater may be placed downstream of a cooling system for performing accelerated cooling. The heater used is preferably a gas burner furnace or induction heating apparatus capable of rapidly heating the steel plate.

As described above, in an exemplary embodiment of the present invention, the number of the MA-producing sites can be increased and MA can be uniformly and finely dispersed through the refining of the austenite grains by applying an accumulative rolling reduction of 50% or more in a no-recrystallization temperature range in austenite not higher than 900° C. Furthermore, in an exemplary embodiment of the present invention, since the coarsening of MA is suppressed by increasing the heating rate during reheating subsequent to accelerated cooling, the equivalent circle diameter of MA can be reduced to 3.0 μm or less. This allows the uniform elongation to be increased to 7% or more as compared with conventional products while a low yield ratio of 85% or less and good low-temperature toughness are maintained.

Furthermore, the decomposition of MA in the steel according to an exemplary embodiment of the present invention is slight and a predetermined metallographic microstructure that is a two-phase microstructure consisting of bainite and MA can be maintained even if the steel suffers such a thermal history that deteriorates properties of conventional steels because of strain ageing. As a result, in an exemplary embodiment of the present invention, an increase in yield strength (YS) due to strain ageing, an increase in yield ratio due thereto, and a reduction in uniform elongation can be suppressed even through a thermal history corresponding to heating at 250° C. for 30 minutes, that is, heating at high temperature for a long time in a coating process for common steel pipes. In the steel according to an exemplary embodiment of the present invention, a yield ratio of 85% or less and a uniform elongation of 7% or more can be ensured even if the steel suffers such a thermal history that deteriorates properties of conventional steels because of strain ageing.

EXAMPLE 1

Steels (Steels A to J) having compositions shown in Table 1 were processed into slabs by continuous casting and steel plates (Nos. 1 to 16) with a thickness of 20 mm or 33 mm were manufactured from the slabs.

Each heated slab was hot-rolled, was immediately cooled in an accelerated cooling system of a water-cooled type, and was then reheated in an induction heating furnace or a gas burner furnace. The induction heating furnace and the accelerated cooling system were arranged on the same line.

Conditions for manufacturing the steel plates (Nos. 1 to 16) are shown in Table 2. Temperatures such as the heating temperature, the finishing rolling temperature, the final (finishing) cooling temperature, and the reheating temperature were the average temperatures of the steel plates. The average temperature was determined from the surface temperature of each slab or steel plate by calculation using a parameter such as thickness or thermal conductivity.

The cooling rate is the average obtained by dividing the temperature difference required for cooling to a final (finishing) cooling temperature (460° C. to 630° C.) by the time taken to perform cooling after hot rolling is finished. The reheating rate (heating rate) is the average obtained by dividing the temperature difference required for reheating to a reheating temperature (540° C. to 680° C.) by the time taken to perform reheating after cooling.

The steel plates manufactured as described above were measured for mechanical property. The measurement results are shown in Table 3. The tensile strength was evaluated in such a manner that two tension test specimens were taken from each steel plate in a direction perpendicular to the rolling direction thereof so as to have the same thickness as that of the steel plate and were subjected to a tension test and the average was determined.

A tensile strength of 517 MPa or more (API 5L X60 or higher) was defined as the preferred strength according to the present invention. The yield ratio and the uniform elongation were each evaluated in such a manner that two tension test specimens were taken from the steel plate in the rolling direction thereof so as to have the same thickness as that of the steel plate and were subjected to a tension test and the average was determined. A yield ratio of 85% or less and a uniform elongation of 7% or more were preferred deformation properties in the present invention.

For the toughness of each base material, three full-size Charpy V-notch specimens were taken from the steel plate in a direction perpendicular to the rolling direction, were subjected to a Charpy test, and were measured for absorbed energy at −20° C. and the average thereof was determined. Those having an absorbed energy of 200 J or more at −20° C. were judged to be good.

For the toughness of each welded heat affected zone (HAZ), three specimens to which a thermal history corresponding to a heat input of 40 kJ/cm was applied with a reproducing apparatus of weld thermal cycles were taken and were subjected to a Charpy impact test. These specimens were measured for absorbed energy at −20° C. and the average thereof was determined. Those having an absorbed energy of 100 J or more at −20° C. were judged to be good.

After the manufactured steel plates were subjected to strain ageing treatment by maintaining the steel plates at 250° C. for 30 minutes, the base materials were subjected to the tension test and the Charpy impact test and the welded heat affected zones (HAZ) were also subjected to the Charpy impact test, followed by evaluation. Evaluation standards after strain ageing treatment were the same as the above-mentioned evaluation standards before strain ageing treatment.

As shown in Table 3, the compositions and manufacturing methods of Nos. 1 to 7, which are examples of the present invention, are within the scope of preferred embodiments of the present invention; Nos. 1 to 7 have a high tensile strength of 517 MPa or more, a low yield ratio of 85% or less, and a high uniform elongation of 7% or more before and after strain ageing treatment at 250° C. for 30 minutes; and the base materials and the welded heat affected zones have good toughness.

The steel plates had a microstructure containing bainite and MA produced therein. MA had a area fraction of 3% to 20%. The area fraction of MA was determined from the microstructure observed with a scanning electron microscope (SEM) by image processing.

The compositions of Nos. 8 to 13, which are examples of the present invention, are within preferred embodiments of the present invention and manufacturing methods thereof are outside preferred embodiments of the present invention. Therefore, the area fraction or equivalent circle diameter of MA in the microstructure of each steel plate is outside preferred embodiments of the present invention. The yield ratio or the uniform elongation is insufficient or good strength or toughness is not achieved before or after strain ageing treatment at 250° C. for 30 minutes. The compositions of Nos. 14 to 16 are outside preferred embodiments of the present invention. Therefore, the yield ratio and uniform elongation of Nos. 14 and 15 are outside preferred embodiments of the present invention and the toughness of No. 16 is poor.

TABLE 1

| Steel | Chemical compositions (mass percent) | | | | | | | | | | | | |
|---|---|---|---|---|---|---|---|---|---|---|---|---|---|
| type | C | Si | Mn | P | S | Al | Nb | Ti | Cu | Ni | Cr | Mo | V |
| A | 0.062 | 0.20 | 2.5 | 0.008 | 0 | 0.03 | 0.034 | 0.014 | — | — | — | — | — |
| B | 0.071 | 0.17 | 1.8 | 0.008 | 0.002 | 0.04 | 0.023 | 0.011 | — | — | — | — | 0.040 |
| C | 0.112 | 0.06 | 1.2 | 0.011 | 0.001 | 0.03 | 0.044 | 0.013 | — | — | 0.35 | — | — |
| D | 0.084 | 0.53 | 1.4 | 0.008 | 0.001 | 0.03 | 0.012 | 0.009 | — | — | — | — | — |
| E | 0.074 | 0.15 | 1.5 | 0.008 | 0.001 | 0.04 | 0.025 | 0.008 | — | 0.25 | — | — | — |
| F | 0.072 | 0.16 | 1.5 | 0.009 | 0.001 | 0.03 | 0.009 | 0.016 | 0.20 | — | 0.30 | — | — |
| G | 0.063 | 0.13 | 1.8 | 0.008 | 0.001 | 0.03 | 0.014 | 0.013 | — | — | — | 0.10 | — |
| H | 0.053 | 0.08 | 1.4 | 0.008 | 0.002 | 0.03 | 0.032 | 0.010 | 0.20 | 0.22 | 0.21 | — | 0.043 |
| I | 0.072 | 0.24 | 1.1 | 0.009 | 0.001 | 0.03 | 0.024 | 0.011 | — | 0.25 | — | 0.22 | — |
| J | 0.131 | 0.09 | 1.2 | 0.008 | 0.001 | 0.03 | 0.035 | 0.014 | — | — | — | — | — |

| Steel | Chemical compositions (mass percent) | | | | $Ar_3$ transformation | | |
|---|---|---|---|---|---|---|---|
| type | Ca | B | N | O | temperature (° C.) | Ti/N | Remarks |
| A | — | — | 0.004 | 0.002 | 691 | 3.5 | Examples |
| B | — | — | 0.005 | 0.001 | 744 | 2.2 | |
| C | — | — | 0.004 | 0.001 | 771 | 3.3 | |
| D | 0.0018 | — | 0.005 | 0.002 | 772 | 1.8 | |
| E | — | — | 0.005 | 0.002 | 753 | 1.6 | |
| F | — | — | 0.006 | 0.002 | 759 | 2.7 | |
| G | — | 0.0010 | 0.004 | 0.002 | 738 | 3.3 | |
| H | — | — | 0.005 | 0.001 | 762 | 2.0 | Comparative |

TABLE 1-continued

| | | | | | | | |
|---|---|---|---|---|---|---|---|
| I | — | — | 0.004 | 0.002 | 768 | 2.8 | Examples |
| J | — | — | 0.004 | 0.002 | 773 | 3.5 | |

* Underlined values are outside the scope of the present invention.

* $Ar_3$ transformation temperature (° C.) = 910-310C—80Mn—20Cu—15Cr—55Ni—80Mo (the symbol of each element represents the content (mass percent) thereof.)

TABLE 2

| No. | Steel type | Plate thickness (mm) | Heating temperature (° C.) | Accumulative rolling reduction at 900° C. or lower (%) | Finishing rolling temperature (° C.) | Initial cooling temperature (° C.) | Cooling rate (° C./s) |
|---|---|---|---|---|---|---|---|
| 1 | A | 33 | 1250 | 75 | 860 | 780 | 20 |
| 2 | B | 20 | 1080 | 75 | 850 | 790 | 35 |
| 3 | C | 33 | 1280 | 70 | 840 | 810 | 15 |
| 4 | D | 20 | 1180 | 75 | 820 | 800 | 40 |
| 5 | E | 20 | 1050 | 60 | 840 | 810 | 35 |
| 6 | F | 20 | 1180 | 50 | 850 | 800 | 40 |
| 7 | G | 20 | 1190 | 75 | 870 | 820 | 35 |
| 8 | D | 20 | 950 | 75 | 850 | 790 | 35 |
| 9 | D | 20 | 1150 | 45 | 890 | 820 | 35 |
| 10 | D | 20 | 1180 | 75 | 860 | 800 | 3 |
| 11 | E | 20 | 1100 | 65 | 860 | 810 | 30 |
| 12 | E | 20 | 1200 | 75 | 870 | 800 | 35 |
| 13 | F | 20 | 1080 | 70 | 820 | 780 | 40 |
| 14 | H | 20 | 1150 | 75 | 860 | 800 | 35 |
| 15 | I | 20 | 1200 | 75 | 820 | 790 | 40 |
| 16 | J | 20 | 1180 | 75 | 820 | 790 | 35 |

| No. | Steel type | Final cooling temperature (° C.) | Reheating unit | Reheating rate (° C./s) | Reheating temperature (° C.) | Remarks |
|---|---|---|---|---|---|---|
| 1 | A | 590 | Induction heating furnace | 2 | 650 | Examples |
| 2 | B | 620 | Induction heating furnace | 5 | 650 | |
| 3 | C | 540 | Induction heating furnace | 2 | 680 | |
| 4 | D | 600 | Induction heating furnace | 3 | 650 | |
| 5 | E | 630 | Gas burner furnace | 3 | 680 | |
| 6 | F | 610 | Induction heating furnace | 3 | 660 | |
| 7 | G | 570 | Induction heating furnace | 5 | 650 | |
| 8 | D | 610 | Induction heating furnace | 7 | 680 | Comparative |
| 9 | D | 580 | Induction heating furnace | 8 | 650 | Examples |
| 10 | D | 600 | Induction heating furnace | 8 | 680 | |
| 11 | E | 460 | Induction heating furnace | 3 | 650 | |
| 12 | E | 620 | Induction heating furnace | 0.3 | 680 | |
| 13 | F | 510 | Induction heating furnace | 7 | 540 | |
| 14 | H | 610 | Induction heating furnace | 9 | 650 | |
| 15 | I | 550 | Induction heating furnace | 9 | 680 | |
| 16 | J | 580 | Induction heating furnace | 2 | 650 | |

* Underlined values are outside the scope of the present invention.

TABLE 3

| | | | | | Before ageing treatment at 250° C. for 30 minute. | | | | |
|---|---|---|---|---|---|---|---|---|---|
| No. | Steel type | Plate thickness (mm) | Volume fraction of MA in microstructure of steel plate (%) | Equivalent circle diameter of MA in steel plate (μm) | Tensile strength (MPa) | Yield ratio (%) | Uniform elongation (%) | Base material toughness vE-20° C. (J) | HAZ toughness vE-20° C. (J) |
| 1 | A | 33 | 12 | 1.8 | 610 | 78 | 10 | 312 | 131 |
| 2 | B | 20 | 10 | 1.4 | 557 | 77 | 10 | 322 | 144 |
| 3 | C | 33 | 15 | 2.8 | 677 | 71 | 8.8 | 234 | 106 |
| 4 | D | 20 | 9 | 1.6 | 624 | 73 | 11 | 284 | 166 |
| 5 | E | 20 | 8 | 1.8 | 633 | 81 | 10 | 318 | 159 |
| 6 | F | 20 | 11 | 1.2 | 574 | 70 | 12 | 353 | 148 |
| 7 | G | 20 | 5 | 1.4 | 533 | 75 | 11 | 365 | 172 |
| 8 | D | 20 | 2 | 2.5 | 502 | 87 | 6.0 | 355 | 188 |
| 9 | D | 20 | 8 | 3.5 | 600 | 77 | 11 | 166 | 137 |
| 10 | D | 20 | 2 | 2.4 | 590 | 85 | 10 | 267 | 135 |
| 11 | E | 20 | 1 | 1.5 | 540 | 92 | 6.2 | 285 | 165 |
| 12 | E | 20 | 1 | 1.6 | 660 | 83 | 6.8 | 288 | 181 |
| 13 | F | 20 | 0 | 1.3 | 660 | 89 | 6.0 | 312 | 112 |
| 14 | H | 20 | 1 | 1.4 | 655 | 90 | 5.6 | 253 | 148 |

TABLE 3-continued

| | | | | | | | | | |
|---|---|---|---|---|---|---|---|---|---|
| 15 | I | 20 | 2 | 1.8 | 623 | 91 | 6.0 | 221 | 155 |
| 16 | J | 20 | 18 | 4.3 | 680 | 66 | 10 | 202 | 13 |

| | | After ageing treatment at 250° C. for 30 minute. | | | | | |
|---|---|---|---|---|---|---|---|
| No. | Steel type | Tensile strength (MPa) | Yield ratio (%) | Uniform elongation (%) | Base material toughness vE-20° C. (J) | HAZ toughness vE-20° C. (J) | Remarks |
| 1 | A | 600 | 79 | 10 | 304 | 122 | Examples |
| 2 | B | 566 | 79 | 10 | 302 | 133 | |
| 3 | C | 655 | 74 | 9.0 | 245 | 115 | |
| 4 | D | 616 | 74 | 10 | 292 | 125 | |
| 5 | E | 621 | 82 | 10 | 294 | 121 | |
| 6 | F | 547 | 73 | 11 | 342 | 155 | |
| 7 | G | 528 | 76 | 11 | 341 | 164 | |
| 8 | D | 510 | 86 | 6.7 | 341 | 175 | Comparative |
| 9 | D | 604 | 78 | 10 | 174 | 124 | Examples |
| 10 | D | 588 | 86 | 9.1 | 255 | 130 | |
| 11 | E | 541 | 91 | 5.2 | 277 | 156 | |
| 12 | E | 642 | 84 | 6.6 | 301 | 156 | |
| 13 | F | 647 | 88 | 6.3 | 304 | 105 | |
| 14 | H | 644 | 89 | 6.4 | 244 | 152 | |
| 15 | I | 630 | 90 | 6.5 | 214 | 123 | |
| 16 | J | 674 | 69 | 8.8 | 222 | 16 | |

* Underlined values are outside the scope of the present invention.

The invention claimed is:

1. A low yield ratio, high strength and high uniform elongation steel plate containing 0.06% to 0.12% C, 0.01% to 1.0% Si, 1.2% to 3.0% Mn, 0.015% or less P, 0.005% or less S, 0.08% or less Al, 0.005% to 0.07% Nb, 0.005% to 0.025% Ti, 0.010% or less N, and 0.005% or less O on a mass basis, the remainder being Fe and unavoidable impurities; the low yield ratio, high strength and high uniform elongation steel plate having a metallographic microstructure that is a two-phase microstructure consisting of bainite and M-A constituent, the area fraction of the M-A constituent being 3% to 20%, the equivalent circle diameter of the M-A constituent being 3.0 μm or less; the low yield ratio, high strength and high uniform elongation steel plate having a uniform elongation of 7% or more and a yield ratio of 85% or less; the low yield ratio, high strength and high uniform elongation steel plate having a uniform elongation of 7% or more and a yield ratio of 85% or less after being subjected to strain ageing treatment at a temperature of 250° C. or lower for 30 minutes or less; wherein the steel plate has a base material toughness of 200 J or more at −20° C., and a tensile strength that is no greater than 677 MPa.

2. The low yield ratio, high strength and high uniform elongation steel plate according to claim 1, further containing one or more selected from the group consisting of 0.5% or less Cu, 1% or less Ni, 0.5% or less Cr, 0.5% or less Mo, 0.1% or less V, 0.0005% to 0.003% Ca, and 0.005% or less B on a mass basis.

3. A method for manufacturing a low yield ratio, high strength and high uniform elongation steel plate, comprising heating steel having the composition specified in claim 1 to a temperature of 1000° C. to 1300° C., hot-rolling the steel at a finishing rolling temperature not lower than the $Ar_3$ transformation temperature such that the accumulative rolling reduction at 900° C. or lower is 50% or more, performing accelerated cooling to a temperature of 500° C. to 680° C. at a cooling rate of 5° C./s or more, and immediately performing reheating to a temperature of 550° C. to 750° C. at a heating rate of 2.0° C./s or more.

* * * * *

UNITED STATES PATENT AND TRADEMARK OFFICE

CERTIFICATE OF CORRECTION

PATENT NO. : 8,926,766 B2
APPLICATION NO. : 13/499455
DATED : January 6, 2015
INVENTOR(S) : Junji Shimamura et al.

It is certified that error appears in the above-identified patent and that said Letters Patent is hereby corrected as shown below:

Title Page 2, col. 1, line 2, item (56) under References Cited, "2005-023403 A" should read --2005-023423 A--.

Signed and Sealed this
Twenty-eighth Day of April, 2015

Michelle K. Lee

Michelle K. Lee
*Director of the United States Patent and Trademark Office*